United States Patent [19]

Wenger

[11] Patent Number: 4,576,317

[45] Date of Patent: Mar. 18, 1986

[54] APPARATUS FOR PREVENTING AIR FROM CONTACTING MOLTEN METAL DURING DISCHARGE THROUGH A SLIDING CLOSURE UNIT

[75] Inventor: Otto Wenger, Zürich, Switzerland

[73] Assignee: Metacon Aktiengesellschaft, Zürich, Switzerland

[21] Appl. No.: 637,010

[22] Filed: Aug. 2, 1984

[30] Foreign Application Priority Data

Sep. 1, 1983 [DE] Fed. Rep. of Germany ..... 3331483

[51] Int. Cl.[4] ..... B22D 41/08

[52] U.S. Cl. ..... 222/600; 222/152

[58] Field of Search ..... 222/603, 600, 598, 590, 222/152, 597; 164/475, 415

[56] References Cited

U.S. PATENT DOCUMENTS

| | | | |
|---|---|---|---|
| 3,523,684 | 8/1970 | Cuscino et al. | 222/600 X |
| 3,887,117 | 6/1975 | Fehling | 222/603 X |
| 3,946,907 | 3/1976 | Berve | 222/152 X |
| 4,076,153 | 2/1978 | Tinnes | 222/512 X |
| 4,365,731 | 12/1982 | Fehling et al. | 222/603 X |

FOREIGN PATENT DOCUMENTS 2417490 7/1975 Fed. Rep. of Germany .

*Primary Examiner*—Joseph J. Rolla
*Assistant Examiner*—Gregory L. Huson
*Attorney, Agent, or Firm*—Wenderoth, Lind & Ponack

[57] ABSTRACT

A sliding closure unit includes at least two refractory plates having therethrough discharge openings, the plates abutting on respective planar sliding surfaces. A generally U-shaped recess is formed in each sliding surface, each recess including a pair of free arms extending toward the other recess. The recesses are dimensioned such that, when the plates are in the open position thereof, the arms of the recesses overlap, thereby forming a connected recessed area encircling the discharge openings. One of the plates has therethrough a channel opening into the recessed area and adapted to be connected to a vacuum source, thereby making it possible to prevent air from contacting molten metal being discharged through the discharge openings.

11 Claims, 3 Drawing Figures

APPARATUS FOR PREVENTING AIR FROM CONTACTING MOLTEN METAL DURING DISCHARGE THROUGH A SLIDING CLOSURE UNIT

BACKGROUND OF THE INVENTION

The present invention is directed to an arrangement for preventing air from contacting molten metal during discharge thereof through refractory plates of a sliding closure unit.

When producing steels such as aluminum-killed steels, for example, it is desirable that during the teeming of the molten steel no air comes near or into contact with the discharged molten metal flow. Therefore, for the pouring of molten steel by means of slide gate nozzles, it has been proposed ("Vesuvius Advanced Technology Systems") to provide in one of the two abutting respective sliding surfaces of the refractory plates of the sliding closure unit a groove or recess which, as a closed configuration, encircles the discharge opening. This groove or recess is charged with an inert gas, such as argon, such that only argon can pass forward into the vacuum spaces created between the sliding surfaces by the discharged flow of molten metal, thereby to prevent contamination of the quality and composition of the metal. Admittedly, such a groove or recess provided as a closed or endless configuration around the discharge opening functions optimally if placed sufficiently close to the discharge opening. However, such positioning does not allow sufficient plate material in the area of the discharge opening for the wear of the discharge opening or of the sliding area.

It also is known, as disclosed in West German DE-AS 24 17 490 to provide abutting sliding surfaces of a sliding closure unit with U-shaped grooves or recesses having free or branch ends directed toward each other, such ends of the recesses overlapping each other and forming a closed loop encircling the discharge opening in all positions, i.e. both the open and closed positions, of the sliding closure unit. Gas under pressure, for example an inert gas, is supplied to the closed loop formed by the overlapping grooves or recesses. This arrangement is provided to prevent infiltration of the molten metal between the refractory plates, which infiltration would block the sliding closure unit. It is assumed that under the influence of a relatively high ferrostatic pressure, particularly involving the use of high capacity steel teeming ladles, the molten steel will find its way into the pores of the plates and/or spaces between the sliding surfaces of the plates when the ferrostatic pressure is higher than the opposing capillary pressure. Although not mentioned in such West German document, the prevention of metal infiltration by means of a pressurized inert gas supplied to the grooves or recesses implies that the flowing stream of molten metal is shielded from atmospheric air, as is the case in the above discussed first-mentioned known arrangement. However, the greatest danger of metal infiltration occurs when the sliding closure unit is in the closed position, so that it is in this position that greatest care must be taken to ensure that the gas pressure in the grooves or recesses stays above the ferrostatic pressure. In other words, in this known West German arrangement, the grooves must overlap when the plates are in the closed position.

SUMMARY OF THE INVENTION

With the above discussion in mind, it is an object of the present invention to provide an arrangement for preventing air from contacting molten metal during discharge thereof through the discharge openings in refractory plates of a sliding closure unit.

It is a further object of the present invention to provide such an arrangement which is operable without the need for an independent supply of an expensive inert gas.

The present invention achieves the above objects by making use of an arrangement of generally U-shaped grooves or recesses, somewhat similar to that of West German DE-AS 24 17 490, but with a different arrangement and for a different purpose.

According to the present invention, the above objects are achieved by the provision, in a sliding closure unit for regulating the discharge flow of molten metal from a metallurgical vessel, such unit being of the type including at least two refractory plates having therethrough discharge openings, the plates abutting on respective planar sliding surfaces, and the plates being relatively displaceable between open and closed positions to bring the discharge openings into and out of alignment, respectively, of means for preventing air from flowing to the discharge openings and contacting the molten metal flowing therethrough. A generally U-shaped recess is formed in each sliding surface, each recess including a pair of free arms or branches extending toward the other recess. The recesses are dimensioned such that, when the plates are in the open position, the arms of the recesses overlap, thereby forming a connected recessed area in the form of a closed loop encircling the discharged openings. One of the plates has therethrough a channel opening into the recessed area and connected to a vacuum source, such that when the plates are in the open position, a vacuum is created in the recessed area to prevent air from contacting the molten metal passing through the discharge openings.

By the provision of the above arrangement, it is possible not only to save the expense of previously employed inert gas, but it also is possible to achieve an improved sealing between the sliding surfaces of the refractory plates. The plates lie close together at all times, since it is not possible for an increased pressure to arise between the two plates tending to separate the plates. At the same time, air is prevented from forcing its way between the sliding surfaces of the plates to contact the flow of molten metal passing through the discharge openings. Thereby, the molten metal, for example killed steel, is prevented from being reoxidized. Thus, in accordance with the present invention there is provided an improved seal between the sliding surfaces of the refractory plates of the sliding closure unit, and at the same time the discharged flow of molten metal is properly shielded from exterior environmental air.

In accordance with a further feature of the present invention, the recesses are dimensioned such that, when the plates are in the closed position, the arms of the recesses do not overlap and are spaced from each other with a recess-free gap therebetween, and the channel opens onto the respective sliding surface at such gap, such that the channel is out of communication with the recesses when the plates are in the closed position. In this manner, the reduced pressure between the sliding surfaces automatically is interrupted when the sliding closure unit is moved to the closed position and when vacuum is not needed. This further reduces the chance of metal infiltrating or creeping between the sliding surface of the plates at the time when this is the greatest danger, i.e. when the plates are in the closed position.

In accordance with a further feature of the present invention, the channel connected to the vacuum source is provided on a stationary plate or plates of the sliding closure unit, such as a stationary bottom plate of a two-plate unit or the inlet and/or outlet stationary plates of a triple-plate unit. In such arrangements, it is possible to provide a conventional pressurized gas inlet connection through the sliding plate. This provides the possibility of using the sliding closure unit, if necessary, with the pressurized gas in the normal manner, whereby the vacuum connection can serve as a controlled pressurized gas return.

BRIEF DESCRIPTION OF THE DRAWINGS

The above and other objects, features and advantages of the present invention will be apparent from the following detailed description, taken with the accompanying drawings, wherein.

DETAILED DESCRIPTION OF THE INVENTION

Figure 1:
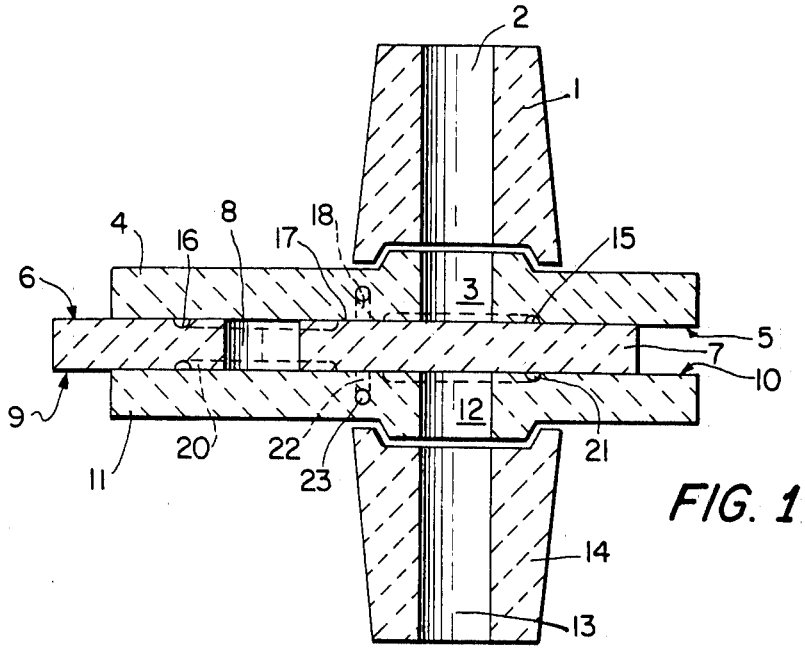
FIG. 1 is a schematic cross-sectional view of a triple-plate sliding closure unit incorporating the present invention, shown in the closed position.

With reference to the drawings, one preferred embodiment of the present invention now will be described in detail. Thus, a sliding closure unit for regulating the discharge flow of molten metal from a metallurgical vessel includes a refractory inlet sleeve adapted to be positioned in a perforated discharge brick of a metallurgical vessel containing molten metal. Inlet sleeve 1 has therethrough a discharge opening 2 communicating with a discharge opening 3 of a stationary refractory inlet plate 4. The unit shown in FIG. 1 is a triple-plate unit and thus includes a stationary refractory outlet plate 11 having therein a discharge opening 12 in alignment with discharge openings 2, 3. Between the the plates 4 and 11 slides a movable refractory plate 7 having therethrough a discharge opening 8 adapted to be moved from a closed position shown in FIG. 1 to an open position whereat discharge opening 8 aligns with discharge openings 2, 3, 12. The unit further includes a refractory outlet sleeve 14 having therethrough a discharge opening 13 aligned with discharge opening 12. Plates 4 and 7 have respective abutting sliding surfaces 5 and 6, and plates 7 and 11 have respective abutting sliding surfaces 9 and 10.

The above described elements are intended to be of conventional construction, and may be mounted to a metallurgical vessel in an operative manner as would be understood by one skilled in the art.

Figure 2:
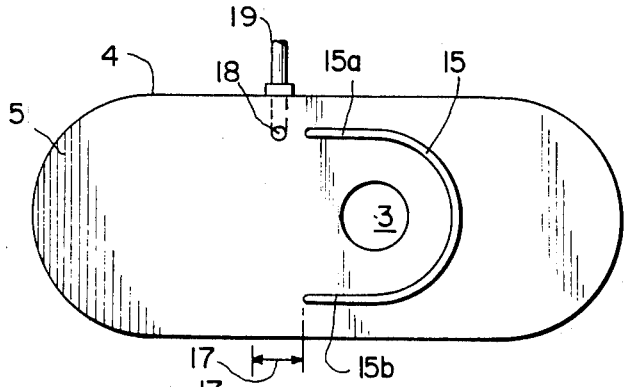
FIG. 2 is a plan view from the bottom of the upper refractory plate shown in FIG. 1.
Figure 3:
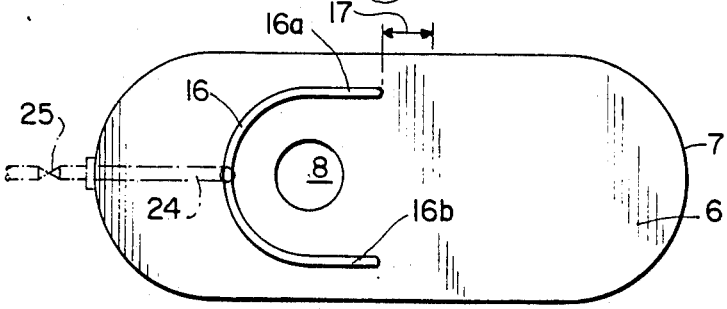
FIG. 3 is a plan view from the top of the middle or sliding plate shown in FIG. 1.

As shown particularly in FIGS. 2 and 3, abutting sliding surfaces 5, 6 have formed therein respective generally U-shaped grooves or recesses 15, 16 extending generally around the respective discharge openings. Each recess 15, 16 includes a pair of free arms or end branches 15*a*, 15*b* and 16*a*, 16*b* directed toward the opposite recess. This relationship particularly is shown in FIG. 1 of the drawings. The recesses are dimensioned such that, when the unit is in the open position the arms of the recesses overlap, thereby forming a connected recess area encircling the respective discharge openings. In other words, when the movable plate 7 is moved to the right of the closed position shown in FIG. 1, arms 16*a*, 16*b* will be moved into communication with the corresponding arms of recess 15, thereby forming a recessed area in the form of a closed loop encircling the discharge openings. This dimensioning is such that this overlapping occurs at all possible throttling positions of the movable plate 7.

However, when the movable plate 7 is in the closed position shown in FIG. 1, the dimensions of the recesses 15, 16 are such that the arms of the recesses do not overlap and are spaced from each other by a recess-free gap 17.

Formed in plate 4 is a bored-hole or channel 18 opening onto the respective sliding surface 5 at a position spaced from one arm 15*a* of recess 15. Therefore, when the movable plate 7 is in the closed position shown in FIG. 1, channel 18 opens into the gap 17 and is not connected to either of recesses 15 or 16. However, when plate 7 is moved to the right of the position shown in FIG. 1 to the open position, the respective arm of recess 16 will be brought into communication with channel 18, and thereby channel 18 communicates with the closed loop recessed area encircling the discharge openings. A connector 19 connects channel 18 to a source of vacuum, for example a vacuum pump. Thereby, when the plate 7 is moved to the open position of the unit, the recessed area encircling the discharge openings is subjected to a vacuum. This operates to prevent air from passing between the sliding surfaces 5, 6 and contacting the molten metal passing through the discharge openings.

When the sliding closure unit is a triple-plate unit as shown in FIG. 1, then the bottom pair of abutting sliding surfaces 9, 10 also are provided with respective grooves or recesses 20, 21, and a channel 22 is formed in plate 11 in a manner similar to that of channel 18. Furthermore, a vacuum connection 23 is connected to channel 22. The arrangement between the lower pair of abutting sliding surfaces operates in the same manner as described above. It of course is to be understood that when the sliding closure unit includes only a single stationary plate, i.e. a two-plate unit, then there will be only one pair of abutting sliding surfaces having grooves or recesses formed therein.

It will be apparent from FIG. 1 that when the movable plate 7 is in the closed position, the grooves 15, 16 are isolated from the vacuum source. However, as soon as the plate 7 is moved sufficiently toward the open position, grooves 16 and/or 20 move into communication with the respective channels and then into overlapping communication with the respective grooves 15 and/or 21. At such time, the vacuum automatically becomes operable to shield radially outwardly the flow of molten metal as soon as it starts to flow through the discharge openings. The closed loop configurations of the recessed areas provides a complete encircling of the respective discharge openings 3, 8 or 8, 12 at the respective sliding surfaces.

It will be understood that in a two-plate unit, outlet sleeve 14 would be connected directly to movable plate 7.

FIG. 3 illustrates a further feature which can be incorporated into the present invention. Thus, movable plate 7 may have therein a gas inlet connection 24 connected to recess 16 and equipped with a shut-off device 25. By this arrangement, it is possible to supply, in a known manner, a pressurized gas, for example inert gas, to the closed-loop recessed area. This arrangement could be employed when vacuum is not available, in which case the inert gas would be returned by channel 18. It also would be possible to employ the inert gas supply in combination with the vacuum source.

Although the present invention has been described and illustrated with respect to preferred features thereof, it is to be understood that various changes and modifications may be made to the specifically described and illustrated arrangements without departing from the scope of the present invention.

I claim:

1. In a sliding closure unit for regulating the discharge flow of molten metal from a metallurgical vessel, said unit being of the type including at least two refractory plates having therethrough discharge openings, said plates abutting on respective planar sliding surfaces, and said plates being relatively displaceable between open and closed positions to bring said discharge openings into and out of alignment, respectively, the improvement of means for preventing air from flowing to said discharge openings and contacting molten metal therein, said preventing means comprising:

a generally U-shaped recess formed in each said sliding surface, each said recess including a pair of free arms extending toward the other said recess, said recesses being dimensioned such that, when said plates are in said open position, said arms of said recesses overlap, thereby forming a connected recessed area encircling said discharge openings;

one of said plates having therethrough a channel opening into said recessed area; and means for connecting said channel to a vacuum source and thereby for, when said plates are in said open position, creating a vacuum in said recessed area and preventing air from contacting molten metal passing through said discharge openings.

2. The improvement claimed in claim 1, wherein said unit includes an inlet stationary plate, an outlet stationary plate, and a removable plate slidable therebetween, said inlet stationary plate and said movable plate abutting on a first pair of said respective sliding surfaces having therein first said recesses defining a first said recessed area when said plates are in said open position, said outlet stationary plate and said movable plate abutting on a second pair of said respective sliding surfaces having therein second said recesses defining a second said recessed area when said plates are in said open position, and each said stationary plate has therethrough a said channel opening into the respective said recessed area when said plates are in said open position.

3. The improvement claimed in claim 1, wherein said recesses are dimensioned such that, when said plates are in said closed position, said arms of said recesses do not overlap and are spaced from each other with a recess-free gap therebetween.

4. The improvement claimed in claim 3, wherein said channel opens onto the respective said sliding surface at said gap, such that said channel is out of communication with said recesses when said plates are in said closed position.

5. The improvement claimed in claim 1, wherein said unit includes a stationary plate and a movable plate, and said channel is formed in said stationary plate.

6. The improvement claimed in claim 5, further comprising means for supplying pressurized gas to said recess of said movable plate, and thereby to said recessed area when said plates are in said open position.

7. In a sliding closure unit for regulating the discharge flow of molten metal from a metallurgical vessel, said unit being of the type including at least two refractory plates having therethrough discharge openings, said plates abutting on respective planar sliding surfaces, and said plates being relatively displaceable between open and closed positions to bring said discharge openings into and out of alignment, respectively, the improvement of means for preventing air from flowing to said discharge openings and contacting molten metal therein, said preventing means comprising:

a generally U-shaped recess formed in each said sliding surface, each said recess including a pair of free arms extending toward the other said recess, said recesses being dimensioned such that, when said plates are in said open position, said arms of said recesses overlap, thereby forming a connected recessed area encircling said discharge openings, and, when said plates are in said closed positions, said arms of said recesses do not overlap and are spaced from each other with a recess-free gap therebetween; and one of said plates having therethrough a channel opening into said recessed area and adapted to be connected to a vacuum source.

8. The improvement claimed in claim 7, wherein said channel opens onto the respective said sliding surface at said gap, such that said channel is out of communication with said recesses when said plates are in said closed position.

9. The improvement claimed in claim 7, wherein said unit includes an inlet stationary plate, an outlet stationary plate, and a removable plate slidable therebetween, said inlet stationary plate and said movable plate abutting on a first pair of said respective sliding surfaces having therein first said recesses defining a first said recessed area when said plates are in said open position, said outlet stationary plate and said movable plate abutting on a second pair of said respective sliding surfaces having therein second said recesses defining a second said recessed area when said plates are in said open position, and each said stationary plate has therethrough a said channel opening into the respective said recessed area when said plates are in said open position.

10. The improvement claimed in claim 7, wherein said unit includes a stationary plate and a movable plate, and said channel is formed in said stationary plate.

11. The improvement claimed in claim 10, further comprising means for supplying pressurized gas to said recess of said movable plate, and thereby to said recessed area when said plates are in said open position.

* * * * *